US006415969B1

(12) United States Patent
Higuchi

(10) Patent No.: US 6,415,969 B1
(45) Date of Patent: Jul. 9, 2002

(54) BABY CARRIER HAVING PAD

(75) Inventor: Junichi Higuchi, Gifu (JP)

(73) Assignee: Lucky Industry Company, Ltd., Ibigun (JP)

( * ) Notice: Subject to any disclaimer, the term of this patent is extended or adjusted under 35 U.S.C. 154(b) by 1 day.

(21) Appl. No.: 09/650,639

(22) Filed: Aug. 30, 2000

(30) Foreign Application Priority Data

Sep. 1, 1999 (JP) ..... 11-247088

(51) Int. Cl.[7] ..... A61G 1/00

(52) U.S. Cl. ..... 224/160; 224/159; 297/467; 297/219.12

(58) Field of Search ..... 224/158, 159, 224/160, 161; D3/213, 214; 297/467, DIG. 11, 452.16, 219.12, 485

(56) References Cited

U.S. PATENT DOCUMENTS 3,027,058 A * 3/1962 Huber
3,587,952 A * 6/1971 Higuchi
4,724,988 A * 2/1988 Tucker ..... 224/160
4,986,458 A * 1/1991 Linday ..... 224/160
5,178,309 A * 1/1993 Bicheler et al. ..... 224/160 X
D378,632 S * 4/1997 Popp
5,690,258 A * 11/1997 Kataoka ..... 224/160

FOREIGN PATENT DOCUMENTS

WO 92016130 A * 10/1992 ..... 224/160

* cited by examiner

*Primary Examiner*—Gregory M. Vidovich
(74) *Attorney, Agent, or Firm*—Armstrong, Westerman & Hattori, LLP

(57) ABSTRACT

A baby carrier having a pad of the present invention comprises a carrier body 10 including at least a back rest 11 and capable of accommodating and holding a baby in both a face-to-face holding manner in which the baby is held such that the back rest 11 is brought into contact with a back of the baby and a forward-facing holding manner in which the baby is held such that the back rest 11 is brought into contact with chest and abdomen of the baby; and shoulder belts 30 and 30 mounted to the carrier body 10 and carried on left and right shoulders; wherein the baby carrier further comprises a pad 40, which can cover the back rest 11, mounted detachably in the carrier body 10, formed wider than a portion which corresponds to a crotch rest portion of the back rest 11 of the carrier body 10 when the carrier body is used in the forward-facing holding. With this structure, it is possible to safely and comfortably hold the baby in any of the face-to-face and forward-facing directions, and to carry the baby laterally and piggyback.

15 Claims, 9 Drawing Sheets

BABY CARRIER HAVING PAD

BACKGROUND OF THE INVENTION

1. Field of the Invention

The present invention relates to a baby carrier used for carrying a baby and walking, and more particularly, to a baby carrier having a pad suitable for holding a baby in both a face-to-face holding manner and a forward-facing holding manner.

2. Description of Related Art

As one of using mode of a usage pattern of a baby carrier used for holding a baby and walking, there is a so-called "holding" a baby in front of a user of the baby carrier. A common manner for holding a baby is to hold the baby in a face-to-face manner such that the baby and the user are opposed to each other as shown in FIG. 6. In the case of this face-to-face holding manner, the user can always check the baby's complexion, the baby is watched by the user and therefore both of them can feel peace of mind. Further, if the baby is sleepy, he or she can lean on the user and sleep in an easy pose, and also when the user auxiliary supports the baby by hands, the baby can be supported stably. Therefore, most baby carriers employ a structure suitable for holding a baby in the face-to-face manner such as to entirely cover from the baby's back to hip.

By the way, a baby has strong curiosity by nature and shows curiosity about peripheral landscape. However, in the case of the face-to-face holding manner, the user interrupts the baby's visual scope and the baby can not satisfy his or her curiosity. Further, if the baby is held in the same pose for a long time, the baby gets tired of being held. For this reason, there are increasing tendencies to prefer holding a baby in the "forward-facing holding manner" in which the baby is faced into the same direction as the user to widen the visual scope. In this case, since the face-to-face holding manner is of course superior to the forward-facing holding manner only in view of the psychic and physical stability, the user does not always hold the baby in the forward-facing holding manner only, and the user switches the holding manners.

Therefore, users used a baby carrier basically for holding a baby in the face-to-face manner. as it is, and an accommodating direction of the baby was turned around with respect to a carrier body so that the baby carrier could be used both for the face-to-face holding manner and the forward-facing holding manner.

However, if a baby carrier originally for holding a baby in the face-to-face holding manner is used for holding the baby in the forward-facing holding manner, there are the following problems.

That is, a human's upper-body and upper and lower extremities bend forwardly (thoracicoabdominal direction), an outer side size in the bending direction is longer than that of an inner side. In order to stably hold such a human body in the carrier body, a back rest for supporting a baby from his or her back to hip is formed wide and a crotch rest for supporting the baby from his or her lower abdomen to inguinal region is formed slightly narrower. If such a baby carrier is used for holding a baby in the face-to-face manner, it is possible to entirely cover the baby's back to hip, and to stably hold the baby. However, if the baby is turned around to the opposite direction and the baby carrier is used for holding the baby in the forward-facing manner, the baby's legs project from lower edges of the back rest toward the back rest in a slightly bending state and thus, a lower portion of the wide back rest supports the baby from his or her lower abdomen to the inguinal region. Further, since the carrier body is suspended, a weight of the baby is concentrated to the lower portion of the back rest, and the lower edges of the back rest presses or bites into the baby's inguinal region. Moreover, in the case of the forward-facing holding, a baby can move arms and legs more freely as compared with the face-to-face holding, the baby moves largely, and the pressure applied to the inguinal region of the baby becomes stronger.

Furthermore, there is a demand that a user wants to use one baby carrier for holding a baby laterally shortly after birth, in addition to the above-described two kinds of holding manners, and after short growth, for carry the baby piggyback.

SUMMARY OF THE INVENTION

In view of the above technical background, it is an object of the present invention to provide a baby carrier having a pad capable of holding a baby in both face-to-face and forward-facing directions, and also capable of safely holding the baby laterally and carrying the baby piggyback.

To achieve the above object, a baby carrier having a pad according to the present invention comprises a carrier body which includes at least a back rest and is capable of accommodating and holding a baby in both a face-to-face holding manner in which the baby is held such that the back rest is brought into contact with a back of the baby and a forward-facing holding manner in which the baby is held such that the back rest is brought into contact with chest and abdomen of the baby and shoulder belts mounted to the carrier body to be carried on left and right shoulders of a user, and the baby carrier further comprises a pad mounted detachably in the carrier body, formed wider than a position which corresponds to a crotch rest portion of the back rest of the carrier body when the baby carrier is used in the forward-facing holding, and which can cover the back rest.

It is preferable that the back rest of the carrier body has a back-width adjusting member for increasing and reducing a back rest width.

It is preferable that a head rest member for stabilizing a head of the baby upwardly projects from an upper portion of the back rest of the carrier body and the head rest member can be detached, and the pad and the head rest member are mounted to the back rest of the carrier body by common catches.

Further, it is preferable that in the carrier body, the back rest is continuously formed at its lower end with a crotch rest which is U-shaped as viewed from side, and the carrier body further comprises a front rest whose lower end edge is connected to a front end edge of the crotch rest and whose upper opposite edges are detachably connected to opposite ears of the back rest. It is preferable that the baby carrier comprises crotch belts pulled out from front end edges of the crotch rest, wherein in a state in which the front rest is separated, tip ends of the crotch belts are detachably fixed to left and right opposite sides respectively of the back rest.

It is preferable that the shoulder belts can be adjusted in lengths when the shoulder belts are put on both shoulders for vertically holding the baby and when the shoulder belts are collectively crossed for laterally holding the baby.

BRIEF DESCRIPTION OF THE DRAWINGS

The present invention will be more fully described and better understood from the following description, taken with the appended drawings in which.

DETAILED DESCRIPTION OF THE PREFERRED EMBODIMENT

One preferred embodiment of the present invention will now be described with reference to the accompanying drawings.

Figure 1:
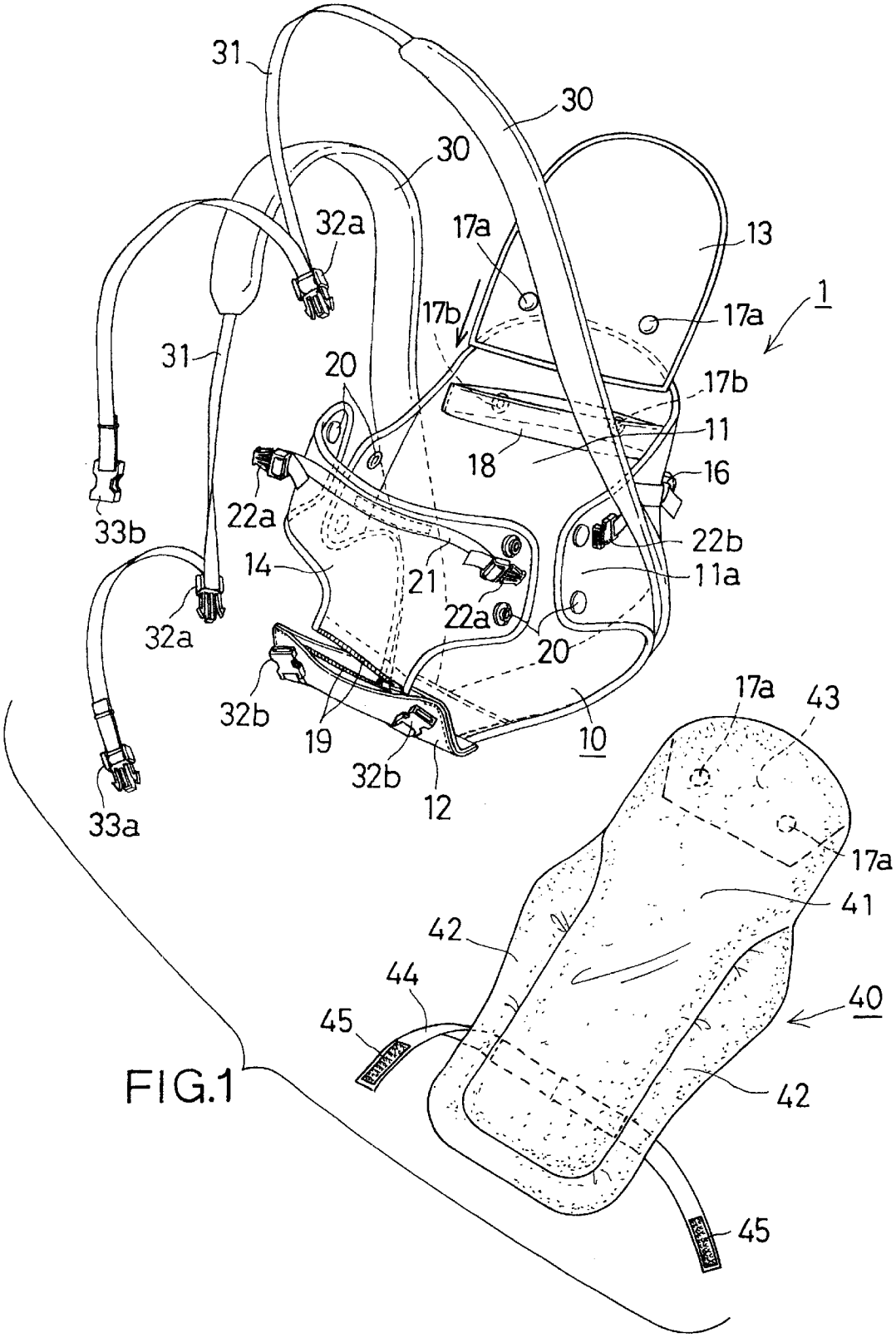
FIG. 1 is a perspective view of a baby carrier having a pad according to one embodiment of the present invention.
Figure 2:
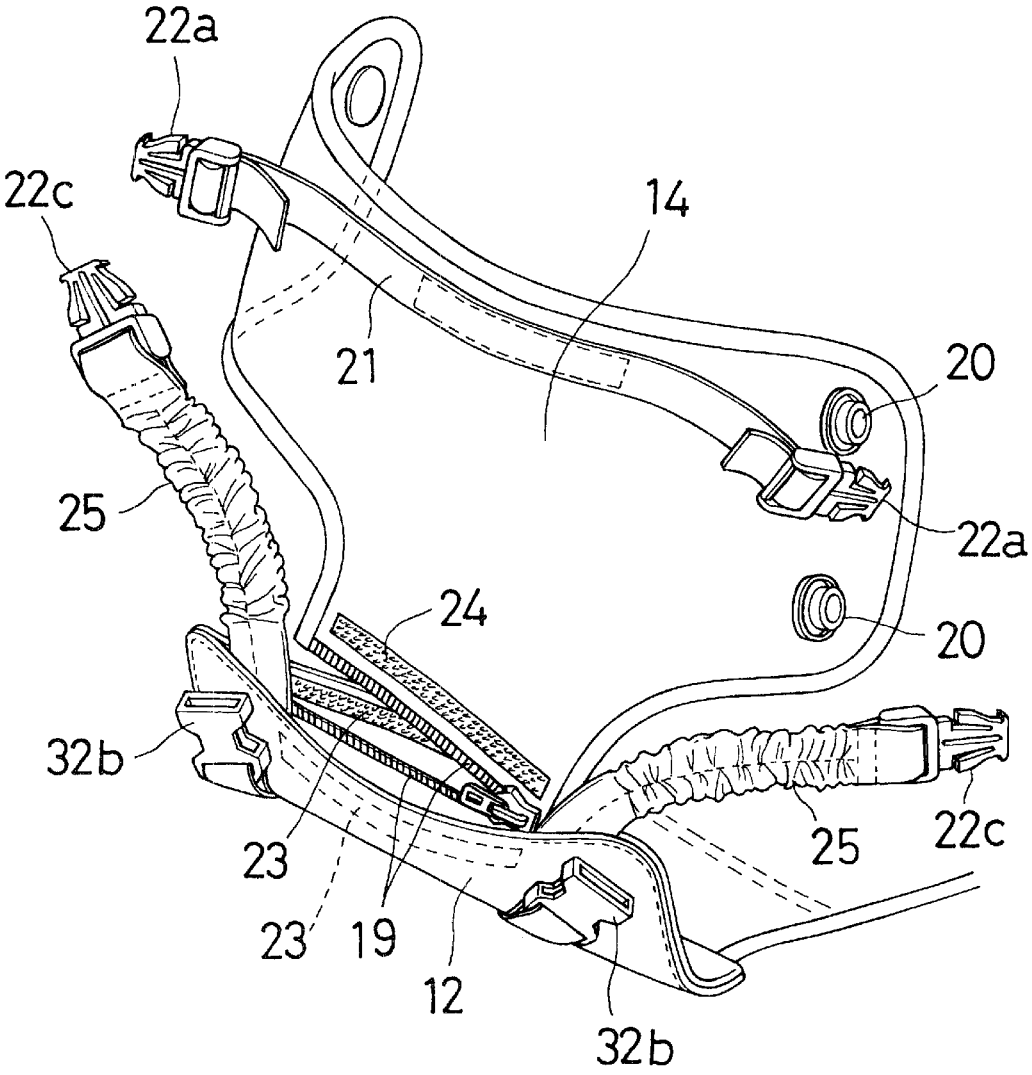
FIG. 2 is a partially enlarged view of FIG. 1.
Figure 3:
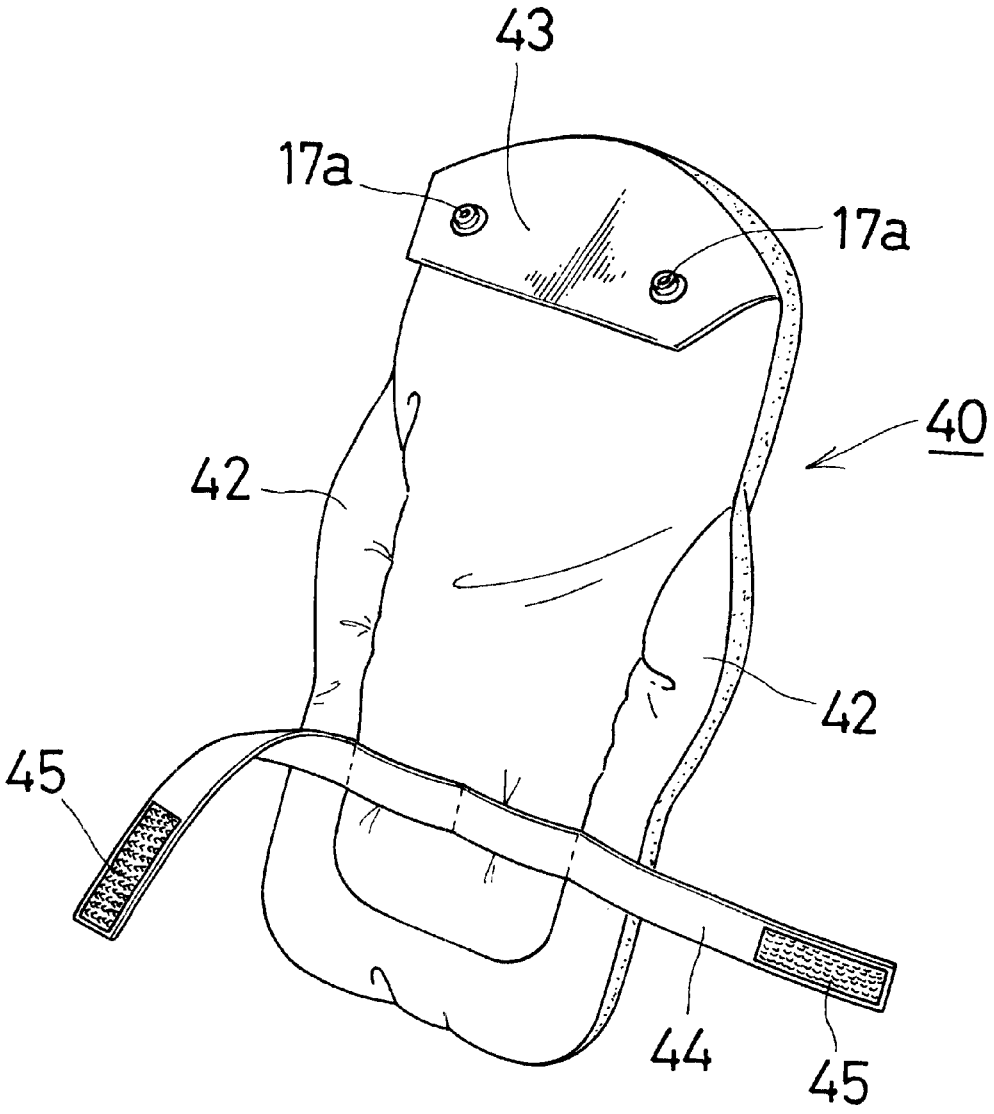
FIG. 3 is a perspective view of a back face of the pad.

A baby carrier 1 shown in FIGS. 1 to 3 comprises a carrier body 10, shoulder belts 30 and a pad 40. The baby carrier 1 can be used in four manners, i.e., a face-to-face holding manner, a forward-facing holding manner, a laterally holding manner, and a carrying piggyback manner.

The carrier body 10 includes a back rest 11, a wide band-like crotch rest 12 which is continuously formed on a lower end of the back rest 11 and has a substantially U-shaped side face, and a front rest 14 which is detachably mounted to the crotch rest 12 and is substantially T-shaped as viewed from front.

A pocket 15 for accommodating small articles is sewn on an outer face of the back rest 11, and a back-width adjusting member 16 for adjusting a width of the back rest 11 is sewn on opposite sides of the pocket 15. In the present embodiment, the illustrated adjusting member 16 comprises two D-rings and an adjusting belt drawn through the D-rings and fastened. Examples of the adjusting member 16 are a popper, a ladder or the like, but the adjusting member 16 is not limited to a specific kind in the present invention.

The crotch rest 12 is formed into a bag-like shape provided at its front end edge with an opening which is opened and closed by a face fastener 23. The crotch rest 12 includes therein a fastener 19 for connecting the front rest 14, and a pair of left and right crotch belts 25 and 25.

The front rest 14 is formed into substantially a T-shape as viewed from front and provided at its lower end edge with the fastener 19. The front rest 14 is detachably connected to the crotch rest 12 near a front end edge of the bag by means of the fastener 19. The front rest 14 is provided at its upper opposite edges with two pairs of upper and lower catches 20 and 20 such as hooks, and detachably connected to tip ends of opposite ears 11*a* and 11*a* of the back rest 11. Face fasteners 24 corresponding to the face fastener 23 for opening and closing the crotch rest 12 are sewn on both upper front and back faces of the fastener 19 so that the opening of the crotch rest 12 can be closed by engaging the face fasteners 23 and 24 even when the front rest 14 is used. When the front rest 14 is not used, it can be removed from the carrier body 10 by separating the fastener 19, or the front rest 14 can be accommodated in the bag of the crotch rest 12.

A medium portion of a single safety auxiliary belt 21 is laterally sewn on an upper outer face of the front rest 14. The safety auxiliary belt 21 is provided as a safeguard in the unlikely event that the catches 20 and 20 of the upper portions of the front rest 14 are disengaged, and first buckles 22*a* and 22*a* of the safety auxiliary belt 21 can be connected to second buckles 22*b* and 22*b* mounted to outer faces of the ears 11*a* and 11*a* of the back rest 11.

Therefore, the carrier body 10 can be changed into a bag-like type in which a baby can be accommodated and held in the carrier body 10 by connecting the front rest 14 to the crotch rest 12 and the back rest 11, and into an open type for holding the baby while loosening the restraint of the baby by separating the front rest 14. The bag type baby carrier has a merit that a baby who has not yet grown sufficient can be held safely and stably, and the open type baby carrier has a merit that a baby who has slightly grown or a baby padded in heavy clothes can be held roomily. Although the baby carrier is changed from the bag type to the open type by separating the front rest 14 from the crotch rest 12 by disengaging the fastener 19, and separating the front rest 14 from the back rest 11 by disengaging the catches 20, the same can also be done by fixedly connecting the front rest 14 on the crotch rest 12 by sewing or the like, and detachably connecting the front rest 14 to the back rest 11. In this case, the front rest 14 separated from the back rest 11 may be connected to the crotch rest 12 formed into the bag-shape and may be accommodated therein. The structure in which the front rest is separated from the crotch rest like the present embodiment has a merit that the crotch rest 12 is not bulky and does not obstruct when the baby carrier is used in the open type, and the latter structure has a merit that there is not adverse possibility that the front rest 14 is lost.

As shown in FIG. 2, each of the left and right pair of crotch belts 25 and 25 is an expansive belt of narrow width which comprising a rubber tape enveloped in cloth. Base ends of the crotch belts 25 and 25 are respectively sewn on left and right opposite ends of the bag of the crotch rest 12 and pulled out from front end edges of the crotch rest 12, and are connected to the second buckles 22*b* and 22*b* of the opposite ears 11*a* and 11*a* of the back rest 11 by buckles 22*c* and 22*c* provided on the tip ends. That is, the second buckles 22*b* and 22*b* can be connected to any of the first buckles 22*a* and 22*a* of the safety auxiliary belt 21 of the front rest 14 and the buckles 22*c* and 22*c* of the crotch belts 25 and 25. When the crotch belts 25 and 25 are not used, they are accommodated in the bag of the crotch rest 12.

A head rest member 13 is a plate member for supporting and stabilizing a baby from his or her neck to head, and is detachably mounted to the back rest 11 such that the head rest member 13 projects upward. The head rest member 13 is attached and detached by using engagement between a catch 17*a* provided on the head rest member 13 and a mating catch 17*b* provided on the back rest 11, and using a pressure band 18.

Figure 4:
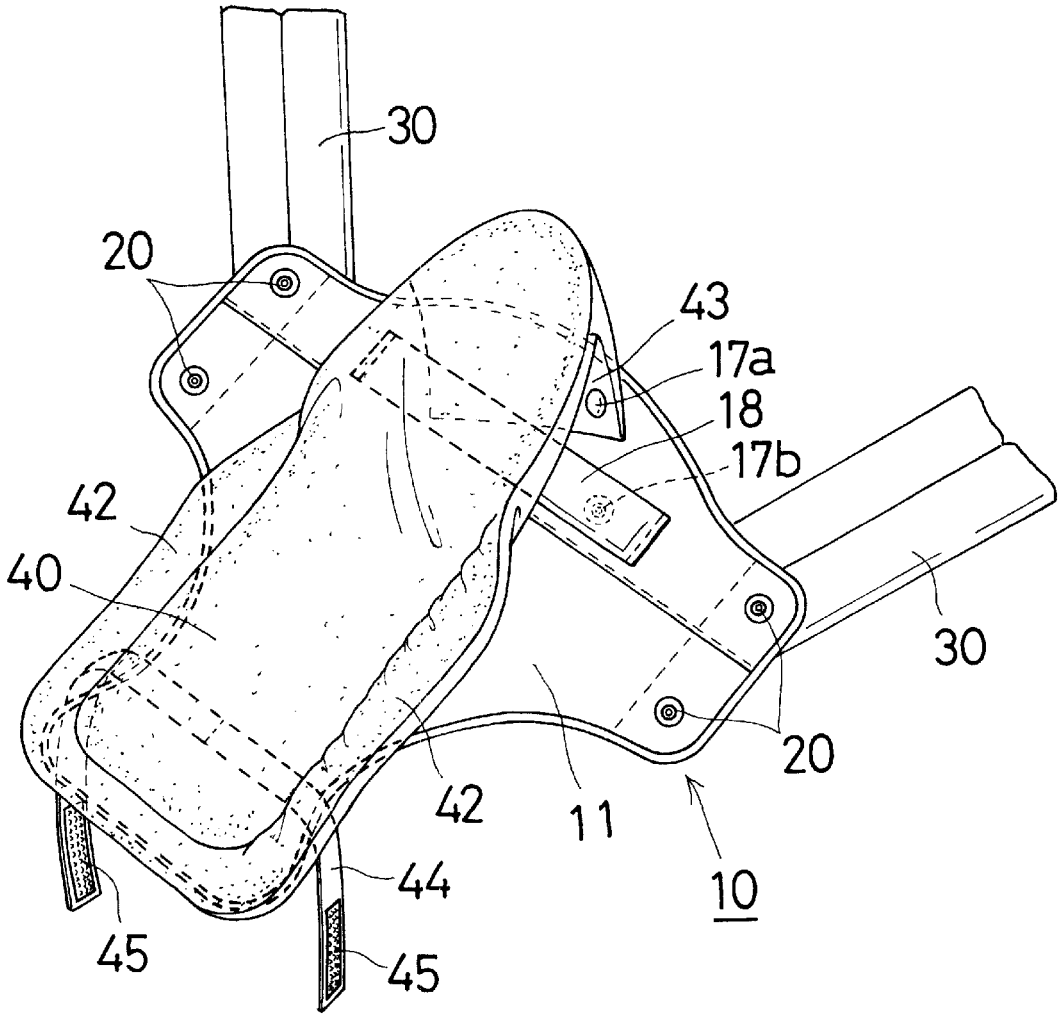
FIG. 4 is a perspective view showing a method for mounting the pad.

As shown in FIGS. 3 and 4, the pad 40 is a cushion material comprising a substantially rectangular body 41 having a length corresponding to a distance between the back rest 11 of the carrier body 10 and the crotch rest 12, and ears 42 projecting from lower opposite sides of the body 41. The pad 40 is detachably mounted to the carrier body 10 by hooking a hook rest 43 provided on the upper end of the back face of the pad 40 onto the pressure band 18 of the back rest 11, and by engaging the catch 17*a* such as hooks with the mating catch 17*b* provided on the back rest 11. A belt 44 sewn on the back face is wound around the carrier body 10 and hooked by face fasteners 45 and 45, thereby preventing the pad 40 from being deviated when it is used. In a state in which the pad 40 is mounted, the body 41 covers the back rest 11, both the ears 42 and 42 formed wider than the back rest 11 project out from the back rest 11 to cover a lower opposite edges, i.e., a position which corresponds to a crotch rest when the baby carrier is used in the forward-facing holding manner. Therefore, pressure acting on a chest of the baby who is held in the forward-facing holding manner can be moderated, and the biting and pressure with respect to the inguinal region can be moderated. Further, the catches 17*a* and 17*b* for mounting the pad 40 to the carrier body 10 are the same as the catches 17*a* and 17*b* for mounting the head rest member 13 to the carrier body 10, and any one of the head rest member 13 and the pad 40 is mounted to the carrier body 10 using the same mating catch 17*b*. It is preferable that a material of the pad 40 has cushioning to moderate a pressure and an impact, and has air permeability for hygienic reason. Examples of the material satisfying the above conditions are: cotton wool of cotton, wool, synthetic fiber or the like, plastic foam such as polyurethane foam, and felt. The pad made of any of these materials may be enveloped in cloth.

A base of each of the left and right pair of shoulder belts 30 and 30 is superposed on a back face of the back rest 11 into a substantially V-shape as viewed from behind, and sewn as one unit, and drawn upward through the upper end face edge of the back rest 11. A portion of each of the belts 30 is formed into a wide band-like shape, and a tip end thereof is formed of narrower band string 31 and 31. Each belt 30 has such a sufficient length that the belt is suitable to be used for holding a baby laterally, which requires longer length than that requires for vertically holding a baby or carrying the baby piggyback.

First buckles 32*a* and 32*a* are mounted to medium portions of the band strings 31 and 31 on the tip end sides of the shoulder belts 30 and 30 such that the mounting positions can be changed by sliding motion. These first buckles 32*a* and 32*a* pair up with mating second buckles 32*b* and 32*b* mounted to opposite edges of a front end outer face of the crotch rest 12. The first buckles 32*a* and 32*a* and the second buckles 32*b* and 32*b* can be detachably connected to each other. A pair of first and second buckles 33*a* and 33*b* is mounted to the tip ends of the band strings 31 and 31 of the shoulder belts 30 and 30 such that the first and second buckles 33*a* and 33*b* can be connected to each other.

The detail structure of various portions of the baby carrier having the pad is not limited to the aforementioned structure illustrated in the drawings.

That is, it is sufficient that the carrier body 10 can stably hold a baby in the face-to-face manner and the forward-facing manner. Although the carrier body 10 can be changed between the bag type and the open type by attaching and detaching the separable front rest 14 in the above embodiment, a baby carrier for bag type only or open type only, or a baby carrier in which the carrier body comprises the back rest only can be used for holding a baby in both the face-to-face manner and the forward-facing manner. As the shoulder belts 30 and 30, other than those comprising a single left belt and a single right belt as in the above embodiment, those comprising one continuous belt and wound around left and right shoulders may be included.

Next, a method for using the baby carrier 1 for four manners, i.e., the face-to-face holding manner, the forward-facing holding manner, the laterally holding manner, and the carrying piggyback manner will be explained.

(Face-to-face holding manner)

First, the head rest member 13 is mounted to the back rest 11 of the carrier body 10, positions of the first buckles 32*a* and 32*a* mounted to the medium portions of both the shoulder belts 30 and 30 are slid and adjusted to an appropriate mounting position such that lengths of the belts is suitable for hanging shoulders.

Figure 5:
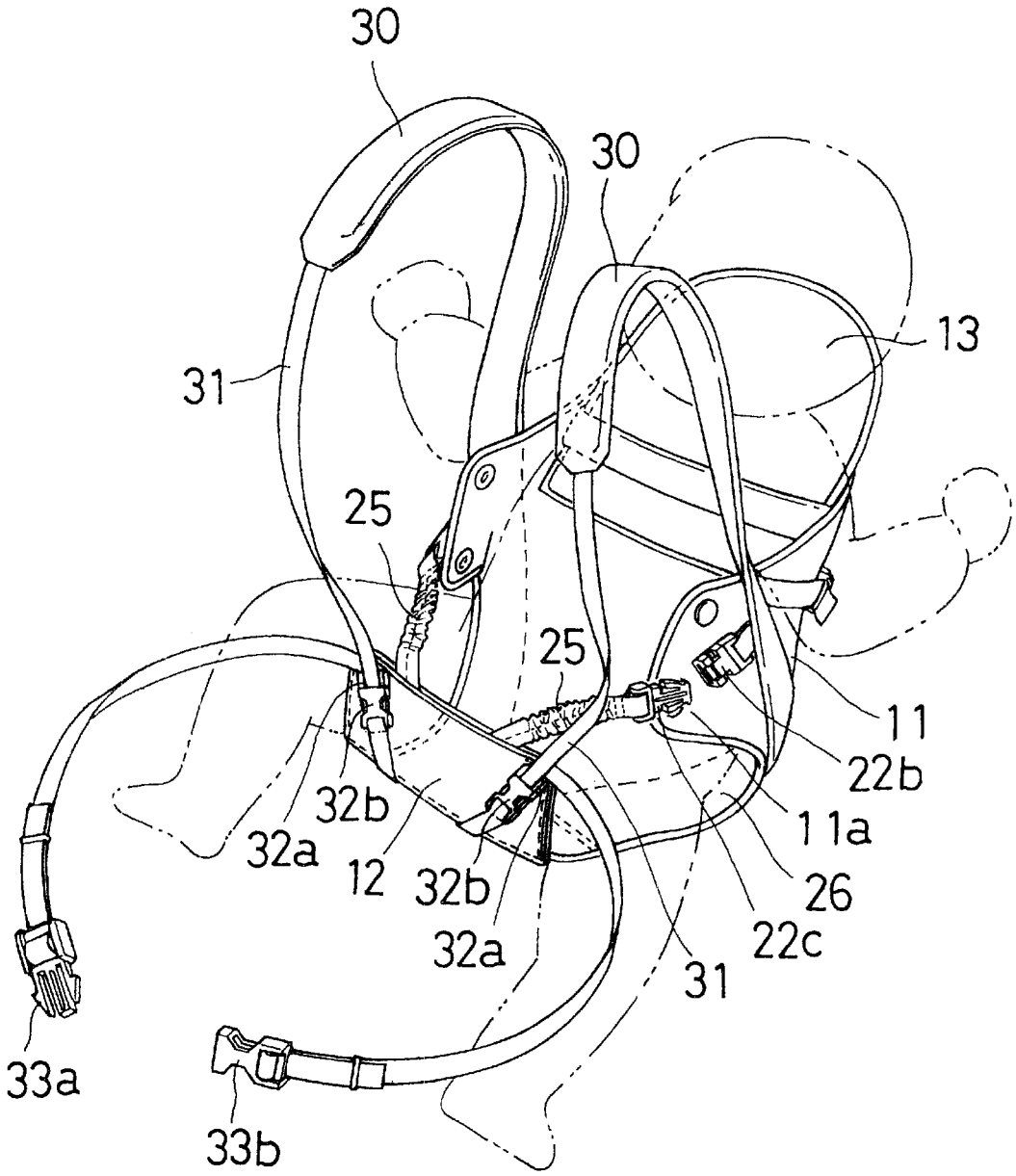
FIG. 5 is a perspective view showing a method of using crotch belts in an open type.

Then, when the carrier body 10 is used as the bag type, the front rest 14 is connected to the crotch rest 12, a baby is placed on the back rest 11 such that a back of the baby is in contact with the back rest 11 and then, the front rest 14 is connected to the back rest 11 to form the carrier body 10 into the bag-shape, and the baby is accommodated therein. As shown in FIG. 5, when it is used as the open type, the front rest 14 is removed, the crotch belts 25 and 25 are pulled out from left and right ends of the crotch rest 12, and the opening of the crotch rest 12 is closed by the face fastener 23. After the baby is placed on the back rest 11, the buckles 22*c* and 22*c* on the tip ends of the crotch belts 25 and 25 are connected and fixed to the second buckles 22*b* and 22*b* of the ears 11*a* and 11*a*, legs of the baby are inserted into left and right leg openings 26 and 26 formed by peripheral edges of the back rest 11 and the crotch rest 12 as well as the crotch belts 25 and 25, thereby accommodating the baby in the carrier body 10.

Figure 6:
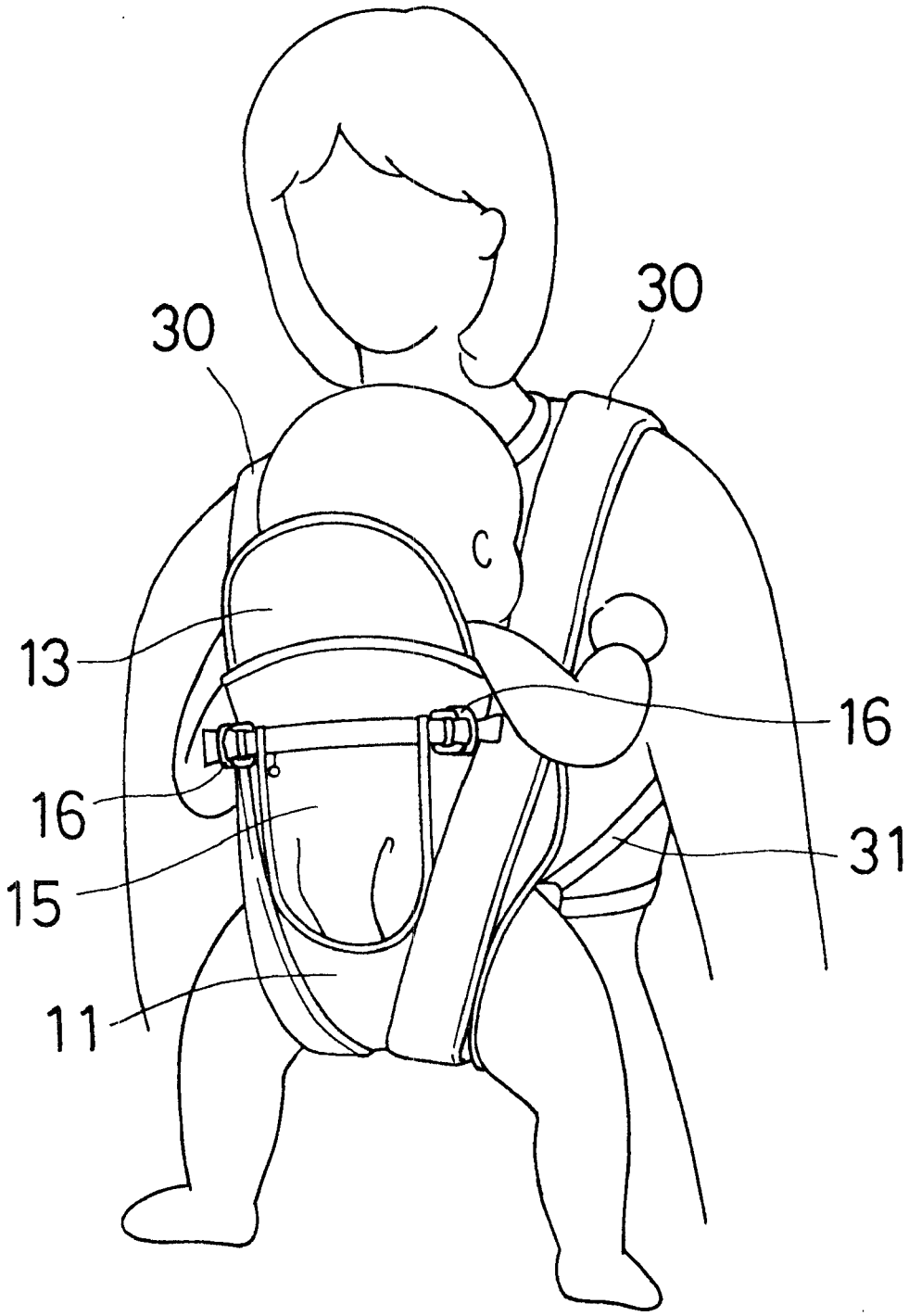
FIG. 6 is a perspective view showing a state in which the baby carrier is used for holding a baby in a face-to-face manner.

The carrier body 10 is positioned on the chest side of the user in this state, the shoulder belts 30 and 30 are hung on shoulders of the user and crossed on the back side, and the first buckles 32*a* and 32*a* are connected to the second buckles 32*b* and 32*b* in the corresponding positions. When remaining portions of the band strings 31 and 31 at the tip ends of the first buckles 32*a* and 32*a* are sufficiently long, the remaining portions are wound around the user's lower back, and the first and second buckles 33*a* and 33*b* on their tip ends are connected to each other. FIG. 6 shows the face-to-face holding state. If the remaining portions are used as lower back belts, the mounting stability is enhanced, and the remaining portions do not encumber. Lengths of the shoulder belts 30 and 30 required for vertically holding a baby in arms or carrying piggyback are shorter than that required for holding a baby laterally. Therefore, the remaining portions are generated on the tip ends of the first buckles 32*a* and 32*a*, but the lengths of the remaining portions are largely varied depending upon whether a baby is held in arms or carried piggyback, and depending upon a physical size of the user and the baby. In generally, when a user holds a baby in arms by crossing the shoulder belts on the back side, the remaining portions are shorter than that required for carrying a baby piggyback. Therefore, the shoulder belts may be short for winding the belts around the lower back in case of holding a baby in arms. However, since the belts are stably mounted by crossing them at the back side, safety is not lowered even if the belts are not wound around the lower back and hooked, and if the remaining portions are short, they do not encumber.

When the baby carrier is used as the open type, in the action for picking up the carrier body 10, the crotch belts 25 and 25 loosely restrain the legs, the crotch rest 12 is lifted to support the lower-body of the baby. Therefore, the baby is prevented from falling, and the shoulder belts 30 and 30 can be mounted safely like the bag type.

(Forward-facing holding manner)

First, as shown in FIG. 4, the pad 40 is mounted to the back rest 11 of the carrier body 10 using the catches 17*a* and 17*b* and the belt 44 instead of the head rest member 13. If the pad 40 is mounted, the inside of the carrier body 10 becomes narrow, but momentum of the baby is increased in the forward-facing holding manner and therefore, the width of the back rest is enlarged by the back-width adjusting member 16 of the back face of the back rest 11. The back-width adjusting member 16 can be used not only for increasing the space in the carrier body 10 when the baby is held in the forward-facing holding manner, but also for enlarging the inside of the carrier body 10 as the baby grows, and it is effective also when the baby carrier 1 is used for holding the baby in the face-to-face manner or laterally or carrying the baby piggyback.

Like the face-to-face holding, the front rest 14 is mounted in the case of the bag type, and the crotch belts 25 and 25 are used in the case of the open type. The baby is accommodated in a direction in which the chest and the abdomen of the baby come into contact with the back rest 11. After the baby is accommodated in the carrier body 10, the shoulder belts 30 and 30 are mounted to the body of the user as in the case of the face-to-face holding.

Figure 7:
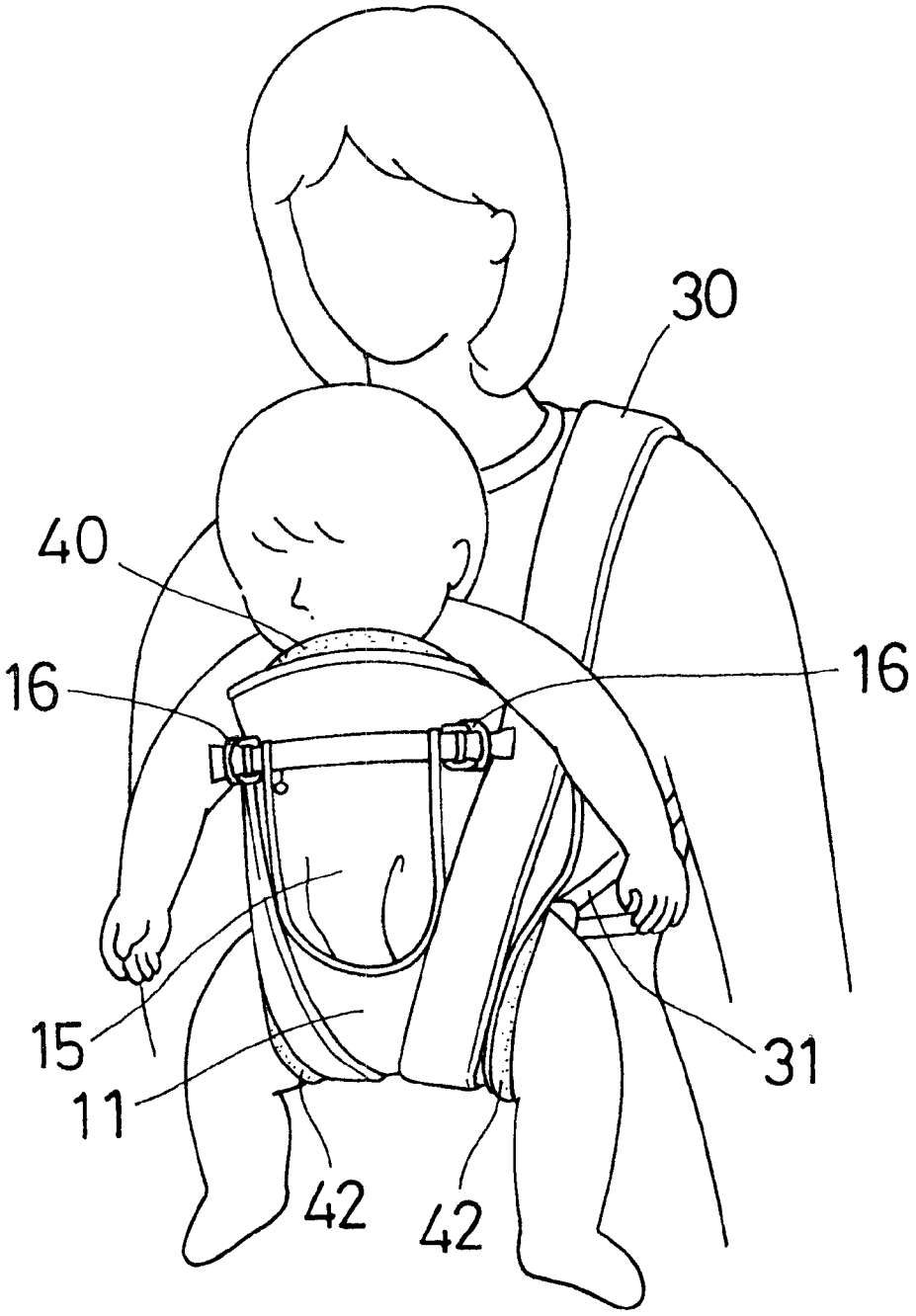
FIG. 7 is a perspective view showing a state in which the baby carrier is used for holding the baby in a forward-facing manner.

In the forward-facing holding shown in FIG. 7, the chest and abdomen of the baby are supported by the back rest 11, the pressure on the chest and abdomen is moderated by the pad 40, projections and depressions due to the sewing are overcome, and the body of the baby is protected. The legs of the baby are projected from the lower opposite edges of the back rest 11, but since the lower opposite edges of the back rest 11 are covered with the ears 42 and 42 of the pad 40, the pressure on the inguinal region is moderated.

(Carrying piggyback manner)

Figure 8:
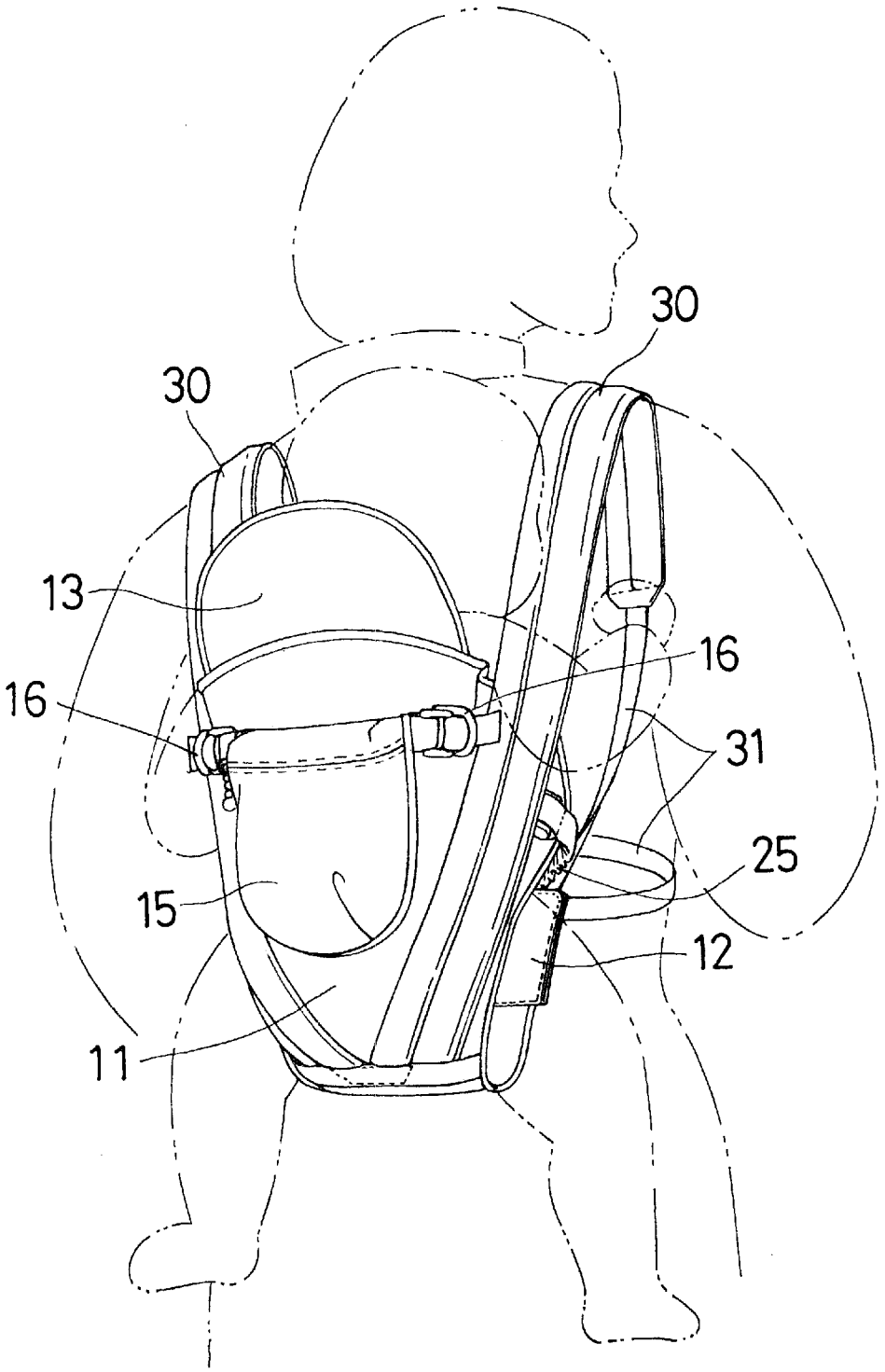
FIG. 8 is a perspective view showing a state in which the baby carrier is used for carry the baby piggyback.

Positions of the first buckles 32*a* and 32*a* mounted to the medium portions of the shoulder belts 30 and 30 are slid and adjusted to a mounting position suitable for carrying a baby in the piggyback manner and then, the baby is accommodated in the carrier body 10 which was adjusted to the bag type or the open type. Then, as shown in FIG. 8, the carrier body 10 is positioned on the back side of the user, the user loops the shoulder belts 30 and 30 on the shoulders and bears the carrier body 10, winds the remaining portions of the band strings 31 and 31 around the lower back of the user, the first and second buckles 33*a* and 33*b* on the tip ends of the remaining portions are connected to each other.

(Laterally holding manner)

First, the head rest member 13 is mounted to the carrier body 10, positions of the first buckles 32*a* and 32*a* mounted to the medium portions of the shoulder belts 30 and 30 are slid and adjusted to mounting positions of appropriate lengths suitable for crossing the belts and then, the first buckles 32*a* and 32*a* are connected to the second buckles 32*b* and 32*b* at the corresponding positions. Since the length of each the shoulder belts 30 and 30 required for holding a baby laterally is longer than that required for holding the baby vertically, the remaining portions of the band strings 31 and 31 on the tip end side from the first buckles 32*a* and 32*a* are extremely short as compared with those when the user holds the baby vertically.

Figure 9:
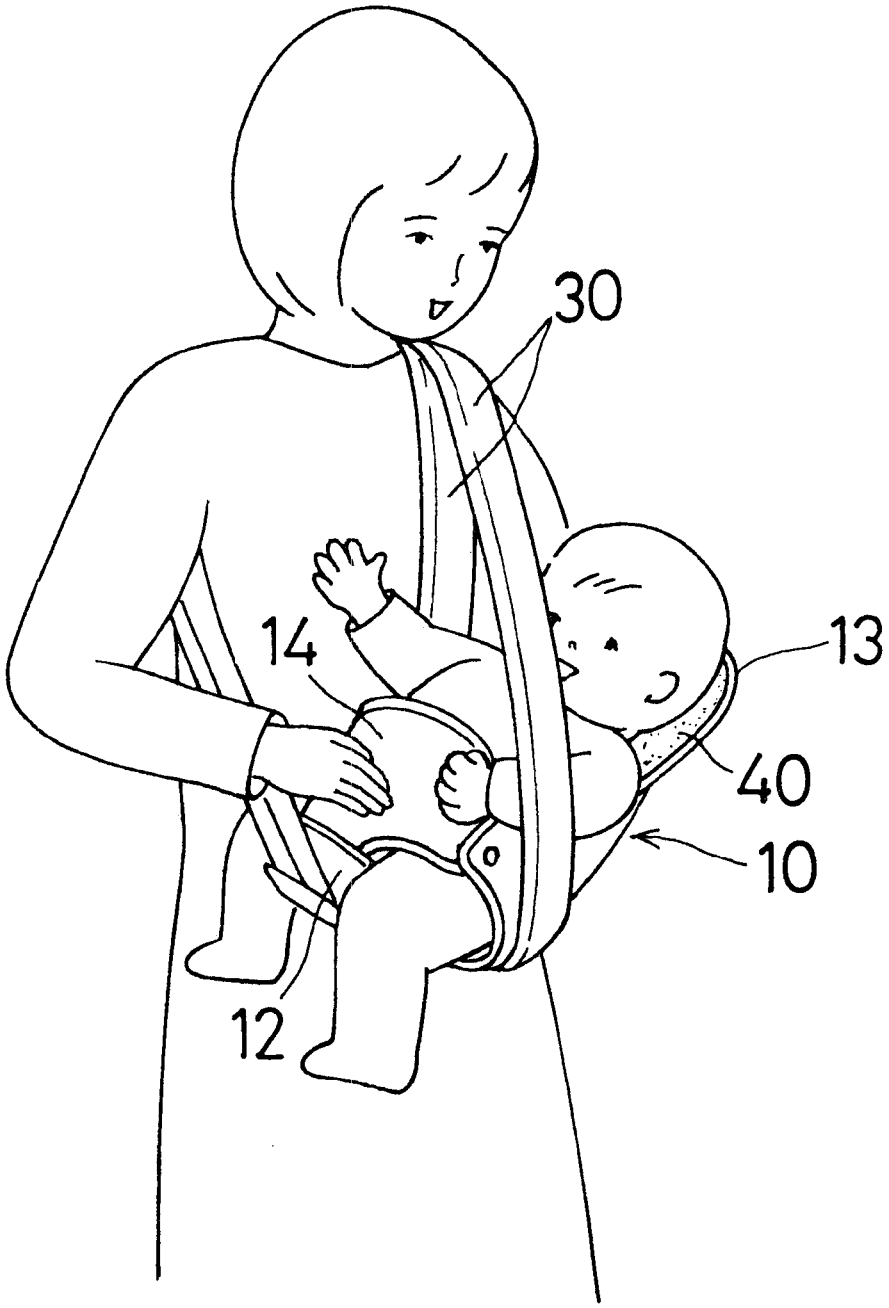
FIG. 9 is a perspective view showing a state in which the baby carrier is used for holding the baby laterally.

Next, the pad 40 is spread within the carrier body 10 which is adjusted into the bag type or the open type, and the baby is accommodated in the carrier body 10. The pad 40 is spread such that the pad 40 lays astride the head rest member 13 and the back rest 11 so that the baby from head to hip can be protected. Then, as shown in FIG. 9, the user binds the left and right shoulder belts 30 and 30 into one and holds in hand and positions the carrier body 10 in front of the user, and the user collectively holds the two shoulder belts 30 and 30 and carries the carrier body 10 such that the shoulder belts 30 and 30 cross on his or her back.

By spreading the pad 40 within the carrier body 10 in this manner, the projections and depressions on the inner face of the carrier body 10 are overcome, impact from outside caused by swinging motion or the like is moderated, and it is possible to enhance the safety, stability of the holding state and comfort.

Since the head rest member 13 is mounted to the back rest 11 of the carrier body 10, the pad 40 is mounted to the carrier body 10 only by winding the belt 44 around the carrier body 10. However, since the lateral holding manner is suitable for a baby who is an infant of small age months and whose moving amount is small, the pad 40 will not be detached during usage even if the pad 40 is simply hooked by the belt 44 or the pad is simply spread. The pad 40 is formed into a length corresponding to a distance from the back rest 11 to the crotch rest 12, and if the pad 40 is pulled up to the position of the head rest member 13, the length of the pad 40 is not sufficient. However, since the lateral holding is suitable for a baby whose height is short and thus, the baby's body placed on his or her back can sufficiently be covered up to the hip, and the pad 40 having the size suitable for the forward-facing holding can be used as pad for the lateral holding without any problem.

As described above, according to the baby carrier having the pad of the present invention, if the pad is removed and a baby is accommodated such that his or her back comes in contact with the back rest, the baby carrier can be used for the face-to-face holding such as to entirely cover the baby by the back rest. If the pad is mounted and the baby is accommodated in the opposite direction, a pressure on the chest and abdomen can be moderated by the pad. Since the pad formed wider than the corresponding portion of the crotch rest covers the opposite edges of the back rest, biting and pressure on the inguinal region can be moderated, and the baby can be held in the forward-facing holding manner with safety and comfort. Thus, the baby can be held with safety and comfortably in both the face-to-face and forward-facing holding manners. If the baby is accommodated in the carrier body in the same direction as the face-to-face manner and the carrier body is disposed on the back side of the user, it can be used for carrying the baby in the piggyback manner.

When the back-width adjusting member for adjusting the width of the back rest is provided on the back rest of the carrier body, the space in the carrier body can be adjusted, the space can be adjusted to the growth of height of the baby of course, the carrier body which becomes narrow by mounting the pad can be widened, and it is possible to hold the baby comfortably in the forward-facing manner which allows larger motion.

Further, when the head rest member for stabilizing the head of the baby is projected upward and detachably mounted to the upper portion of the back rest of the carrier body, it is possible to enhance the safety of the holding state of the face-to-face holding manner, the carrying piggyback manner, and the lateral holding manner. Furthermore, when the pad and the head rest member are mounted to the back rest of the carrier body by common catches, it is possible, with the small number of parts, to use the pad and the head rest member in different ways such that the pad is mounted in the case of the forward-facing holding manner, the head rest member is mounted in the case of the face-to-face holding manner and the like, which is advantageous in terms of costs. The projections and depressions in the carrier body can be reduced by using the common parts, and the holding comfort is excellent.

If a lower end of the back rest is continuously formed with the crotch rest which is substantially U-shape as viewed from side, and if the carrier body includes the front rest whose lower end edge is connected to a front end edge of the crotch rest and whose upper opposite edges are detachably connected the ears of the back rest, the carrier body can easily be changed into the bag type using the front rest and the open type using no front rest, and it can be used for a long time in correspondence to the growth of the baby.

In a state in which the crotch belts are pulled out from the front end edge of the crotch rest and the front rest is separated, when its tip ends has a leg belt which are detachably fixed to the left and right sides of the back rest, in the carrier body lifting motion when it is used in the open type, the leg belt loosely restrains the legs, the crotch rest is lifted to support the lower-body of the baby and therefore, the baby is prevented from falling, and the mounting motion of the shoulder belts can be carried out with safety like the bag type.

Further, when the shoulder belts can be adjusted in lengths when they are used in vertical holding manner and both shoulder hooking and when they are used for laterally holding and the left and right belts are collectively crossed, it can meet the lateral holding which requires long shoulder belts and, in addition to the face-to-face holding, the forward-facing holding and carrying piggyback, the lateral holding can be done. Therefore, it can be used for holding a baby laterally just after he or she was born, it can be used in the two holding manners, i.e., face-to-face and forward-facing manners and carrying piggyback manner, and one baby carrier can be used for a long time.

The present invention claims a priority based on Japanese Patent Application No.11-247088 filed on Sep. 1, 1999, the content of which is incorporated hereinto by reference in its entirety.

The terms and descriptions in this specification are used only for explanatory purposes and the present invention is not limited to these, but many modifications and substitutions may be made without departing from the spirit of the scope of the present invention which is defined by the appended claims.

What is claimed is:

1. A baby carrier comprising:

a carrier body which includes at least a back rest and is capable of accommodating and holding a baby in both a face-to-face holding manner in which the baby is held such that said back rest is brought into contact with the back of the baby and a forward-facing holding manner in which the baby is held such that the back rest is brought into contact with the chest and abdomen of the baby;

shoulder belts mounted to said carrier body to be carried on left and right shoulders of a user; and a pad provided inside of said carrier body, said pad formed wider than a width of a portion which corresponds to a crotch rest portion of said back rest of said carrier body in a portion of the pad that covers the crotch rest portion when the baby carrier is used with the baby in the forward-facing holding manner;

wherein the back rest has a length such that an upper edge of the back rest is located approximately at a shoulder portion of the baby when the baby is held in the face-to-face holding manner;

wherein the back rest comprises a sheet member sized to substantially cover the back and chest of the baby when the baby is held in the face-to-face manner and the forward facing manner, respectively; and wherein the pad comprises cushioning material.

2. A baby carrier having a pad according to claim 1, wherein said back rest of said carrier body includes a back-width adjusting member for increasing and reducing a back rest width.

3. A baby carrier according to claim 1, wherein a head rest member for stabilizing a head of the baby upwardly projects from an upper portion of said back rest of said carrier body and said head rest member can be detached.

4. A baby carrier according to claim 2, wherein a head rest member for stabilizing a head of the baby upwardly projects from an upper portion of said back rest of said carrier body and said head rest member can be detached.

5. A baby carrier according to claim 3, wherein said pad and said head rest member are alternatively mounted to said back rest of said carrier body by respective common catches.

6. A baby carrier according to claim 4, wherein said pad and said head rest member are alternatively mounted to said back rest of said carrier body by respective common catches.

7. A baby carrier according to claim 1, wherein in said carrier body, said back rest is continuously formed at its lower end with said crotch rest portion which is U-shaped as viewed from side, and said carrier body further comprises a front rest whose lower end edge is connected to a front end edge of said crotch rest portion and whose upper opposite edges are detachably connected to opposite ears of said back rest.

8. A baby carrier according to claim 2, wherein in said carrier body, said back rest is continuously formed at its lower end with said crotch rest portion which is U-shaped as viewed from side, and said carrier body further comprises a front rest whose lower end edge is connected to a front end edge of said crotch rest portion and whose upper opposite edges are detachably connected to opposite ears of said back rest.

9. A baby carrier according to claim 3, wherein in said carrier body, said back rest is continuously formed at its lower end with said crotch rest portion which is U-shaped as viewed from side, and said carrier body further comprises a front rest whose lower end edge is connected to a front end edge of said crotch rest portion and whose upper opposite edges are detachably connected to opposite ears of said back rest.

10. A baby carrier according to claim 4, wherein in said carrier body, said back rest is continuously formed at its lower end with said crotch rest portion which is U-shaped as viewed from side, and said carrier body further comprises a front rest whose lower end edge is connected to a front end edge of said crotch rest portion and whose upper opposite edges are detachably connected to opposite ears of said back rest.

11. A baby carrier according to claim 5, wherein in said carrier body, said back rest is continuously formed at its lower end with said crotch rest portion which is U-shaped as viewed from side, and said carrier body further comprises a front rest whose lower end edge is connected to a front end edge of said crotch rest portion and whose upper opposite edges are detachably connected to opposite ears of said back rest.

12. A baby carrier according to claim 6, wherein in said carrier body, said back rest is continuously formed at its lower end with said crotch rest portion which is U-shaped as viewed from side, and said carrier body further comprises a front rest whose lower end edge is connected to a front end edge of said crotch rest portion and whose upper opposite edges are detachably connected to opposite ears of said back rest.

13. A baby carrier according to anyone of claims 7 to 12, further comprising crotch belts pulled out from front end edges of said crotch rest portion, wherein in a state in which said front rest is separated, tip ends of said crotch belts are detachably fixed to left and right opposite sides respectively of said back rest.

14. A baby carrier according to anyone of claims 7 to 12, wherein said shoulder belts can be adjusted in lengths when said shoulder belts are put on both shoulders for vertically holding the baby and when said shoulder belts are collectively crossed for laterally holding the baby.

15. A baby carrier according to anyone of claims 7 to 12, further comprising crotch belts pulled out from front end edges of said crotch rest portion, wherein in a state in which said front rest is separated, tip ends of said crotch belts are detachably fixed to left and right opposite sides respectively of said back rest, and said shoulder belts can be adjusted in lengths when said shoulder belts are put on both shoulders for vertically holding the baby and when said shoulder belts are collectively crossed for laterally holding the baby.

* * * * *